US007490537B1

(12) United States Patent
Vande Brake

(10) Patent No.: US 7,490,537 B1
(45) Date of Patent: Feb. 17, 2009

(54) SUPPRESSION APPARATUS FOR EXPLOSIVE DEVICES

(75) Inventor: Todd Evan Vande Brake, Peyton, CO (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/917,295

(22) Filed: Aug. 13, 2004

(51) Int. Cl.
*F42B 33/00* (2006.01)

(52) U.S. Cl. ..... 86/50

(58) Field of Classification Search ..... 86/50; 62/457.3

See application file for complete search history.

(56) References Cited

U.S. PATENT DOCUMENTS

| | | | | | |
|---|---|---|---|---|---|
| 3,721,201 | A * | 3/1973 | Boller | 109/49.5 |
| 3,766,975 | A * | 10/1973 | Todd | 165/74 |
| 3,786,956 | A | 1/1974 | Tabor | |
| 3,800,715 | A * | 4/1974 | Boller | 109/49.5 |
| 3,820,479 | A * | 6/1974 | Venable | 109/1 R |
| 4,027,601 | A | 6/1977 | Hickerson | |
| 4,402,195 | A * | 9/1983 | Campbell | 62/457.3 |
| 4,570,454 | A * | 2/1986 | Campbell | 62/457.3 |
| 4,625,518 | A * | 12/1986 | Freedman | 62/1 |
| 4,836,079 | A * | 6/1989 | Barrett | 86/50 |
| 4,928,412 | A * | 5/1990 | Nishiyama | 40/324 |
| 5,044,173 | A * | 9/1991 | Cheng | 62/372 |
| 5,207,076 | A * | 5/1993 | Sciarrillo | 62/457.4 |
| 5,339,982 | A * | 8/1994 | Tardie | 220/708 |
| 5,345,784 | A * | 9/1994 | Bazemore et al. | 62/371 |
| 6,595,247 | B1 | 7/2003 | Landy et al. | |
| D511,366 | S * | 11/2005 | Brown | D22/112 |
| 6,976,578 | B1 * | 12/2005 | Kenihan | 206/222 |
| 2004/0250566 | A1 * | 12/2004 | Roth et al. | 62/457.2 |
| 2005/0092646 | A1 * | 5/2005 | Cohen et al. | 206/527 |
| 2005/0115384 | A1 * | 6/2005 | Reynolds | 86/50 |
| 2005/0194340 | A1 * | 9/2005 | Huang | 215/6 |

FOREIGN PATENT DOCUMENTS

| | | | |
|---|---|---|---|
| FR | 2852196 | A3 * | 9/2004 |
| RU | 2 125 232 | C1 | 1/1999 |

(Continued)

OTHER PUBLICATIONS

EOD Disrupter Containment Cylinder—for Large Munitions http://www.soacorp.com/eod_disrupter.php (retrieved Oct. 30, 2006).*

(Continued)

*Primary Examiner*—Troy Chambers
(74) *Attorney, Agent, or Firm*—Edell, Shapiro & Finnan, LLC

(57) ABSTRACT

A suppression apparatus for a suspected explosive device comprising a container which surrounds a cavity, wherein the container is shaped such that when filled with liquid, the liquid has an outer boundary of cylindrical shape and an inner boundary of frusto-conical shape wherein the slope of the inner boundary relative to the outer boundary is of such magnitude to create a variation in the thickness of the liquid between the inner and outer boundaries which renders the shot line through the liquid of an explosion from an explosive device to be about uniform when the explosive device is located in the cavity on a surface on which the container sits.

17 Claims, 4 Drawing Sheets

FOREIGN PATENT DOCUMENTS

| | | |
|---|---|---|
| RU | 2 150 669 C1 | 6/2000 |
| RU | 2 150 670 C1 | 6/2000 |

OTHER PUBLICATIONS

Blast Guard Air Foam Systems, Backpack Air Foam System, http://www.xtek.net/catalogue/eod/bguard2.shtml, Jan. 4, 2002.

Creative Building Products, EOD Disrupter Water filled Blast/Shrapnel Containment Cylinder, http://www.soacorp.com/eod_disrupter.htm, Aug. 23, 2002.

CINTEC North America, Waterwall™ Technology—Specialised Applications, Blastec Bomb Bin.

Blast Inhibitors "Fountain", http://www.npo-sm.ru/equip/fontan_e.html, Fountain, Nov. 26, 2001.

* cited by examiner

SUPPRESSION APPARATUS FOR EXPLOSIVE DEVICES

STATEMENT REGARDING FEDERALLY SPONSORED RESEARCH OR DEVELOPMENT

The United States Government has a paid-up license in this invention and the right in limited circumstances to require the patent owner to license others on reasonable terms as provided for by the terms of Contract No. DAAD 05-01-D-0017.

BACKGROUND OF THE INVENTION

1. Field of the Invention

The present invention is directed to a suppression apparatus for explosive devices.

2. Background of the Invention

In recent years, particularly since Sep. 11, 2001, a major concern has been how to deal with unattended articles left in public places which are suspected to be, or to contain explosive devices. Since the first responder in such cases, e.g., security guard, police or fire department may not have the expertise to determine the nature of the device and/or to disarm it, it is important to isolate the device from its surroundings and to contain and suppress any explosion which may occur while the area is evacuated and the second responder (e.g., a bomb squad) is called.

To meet this need, several different types of systems have been proposed in the prior art. For example, in systems employing foam, a tent made of ballistic material is placed around a suspected device and is filled with foam, which acts to suppress any blast and resulting fragments. However, disadvantages of this type of system are that a large water source and pump are necessary to generate the aqueous foam solution, and once the device is put into place access is precluded so that the device cannot be disarmed.

In systems which are "soft-sided" the explosive device must sometimes be picked up and placed into a container, which is considered to be a negative feature. Bomb blankets, which fall into the "soft-sided" category, typically provide little protection, as they are propelled upwardly from the explosion and fragments are free to escape radially around the device.

In prior art systems which are hard-sided, typically a container made of high strength steel is utilized, which contains the explosion and/or releases the overpressure in a controlled manner. Such systems find use in mail rooms and airport baggage areas. However, hard-sided systems typically require the suspected device to be placed into the system, which as mentioned above is an undesirable feature. In addition, hard-sided containers are very heavy (typically over 250 lbs), which preclude them from being man-portable.

There also exist in the prior art, systems including containers which are filled with liquid such as water and which are constructed so that the liquid inside the container is in the shape of a hollow cylinder having a predetermined, uniform thickness. There is typically an open cavity located interiorly of the container, and the container is placed over the suspected device so that the device is fully within the cavity and is surrounded by the container and liquid. The container may also be wrapped with ballistic material. While liquid such as water is in general an effective medium for suppressing explosions, it has been found that the devices of the prior art generally allow too many explosive fragments to penetrate the container walls and escape to the outside where they may cause damage.

SUMMARY OF THE INVENTION

It is thus an object of the present invention to provide an improved containment apparatus for explosive devices.

In accordance with an aspect of the invention, a containment apparatus is provided comprising a container which is shaped such that when it is filled with liquid, the liquid has an outer boundary of cylindrical shape and an inner boundary of frusto-conical shape, there being a cavity in a region interior to the inner boundary where a suspected explosive device may be located on a surface on which the container is to sit. Additionally, the frusto-conical shape is sloped relative to the cylindrical shape to a degree such to create a variation in the thickness of the liquid which renders the shot line for an explosion from the suspected explosive device to be about uniform.

The uniform shot line provided by the containment apparatus of the invention results in more efficient use of the liquid for suppressing fragments from an explosive device.

DETAILED DESCRIPTION OF THE PREFERRED EMBODIMENTS

Figure 1:
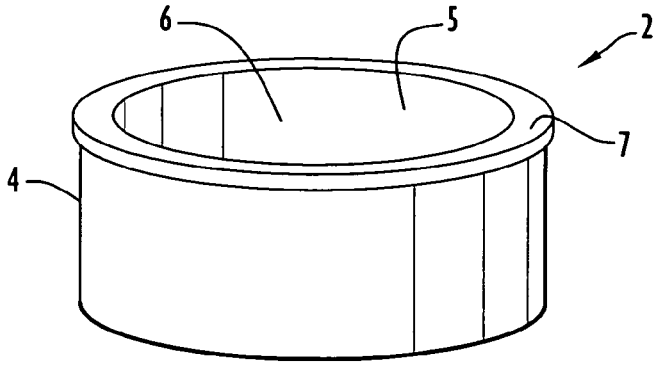
FIG.1 PRIOR ART
FIG. 1 shows a prior art containment apparatus for an explosive device.

As mentioned above, FIG. 1 depicts a containment apparatus of the prior art. As can be seen in the Figure, container 2 is a cylindrical shell comprised of outer cylindrical wall 4, inner cylindrical wall 5, top portion 7 which is disposed between the outer and inner walls at the tops thereof and a bottom portion (not shown, which is disposed between the outer and inner walls at the bottoms). The shell is filled with a liquid such as water or a combination of water and an anti-freezing agent, and both the shell and the cylinder of liquid contained therein surround central cavity 6.

Emergency personnel, who would be alerted when a suspected explosive device is found might typically be from a security, police, or fire department and would carry the shell to the location of the suspected article, and would place it over the article so that the article is within the cavity and is surrounded by the shell. That is, the shell would sit on the same surface as the article and the article would be within cavity 6. A lid may be placed over the top of the container, covering the cavity and the shell may be wrapped with ballistic material. Any explosion which would occur would thus be absorbed by the liquid, the shell, and the ballistic material. As discussed above, a problem with the prior art device shown in FIG. 1 is that too many exploded fragments have been found to penetrate the shell, being propelled to the outside where they can cause personal injury and property damage.

Figure 2:
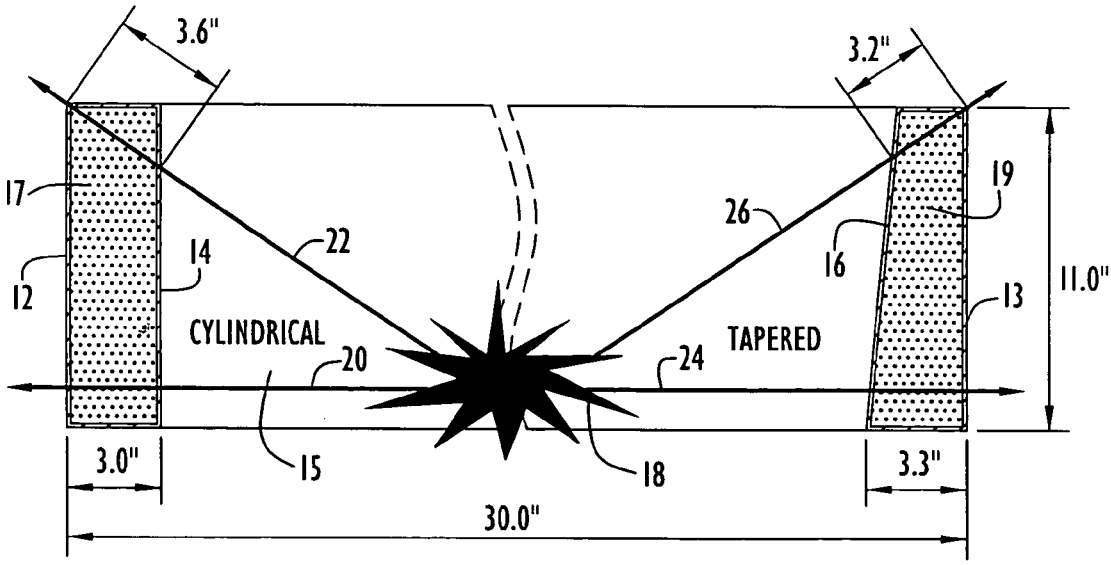
FIG. 2 is a diagrammatic representation which illustrates the principle of the present invention.

The principle of the invention is illustrated in connection with FIG. 2, which diagrammatically represents a composite of two different systems for purposes of comparison. The left portion of the figure depicts a shell comprised of outer cylindrical wall 12 and inner cylindrical wall 14 containing liquid 17 therebetween, identical to the prior art device of FIG. 1. However, the right portion of the Figure depicts a shell comprised of outer cylindrical wall 13, but in accordance with the present invention an inner wall 16 which is frusto-conical in shape, liquid 19 being contained between the two walls. Furthermore, a hypothetical explosion 18 from a suspected explosive device within the cavity 15 is shown as occurring. It will now be demonstrated that the shot line of the explosion through the liquid for the prior art device of FIG. 1 is quite non-uniform while the shot line through the liquid for the apparatus of the invention is essentially uniform.

Referring to the left portion of the Figure, it is seen that shot line 20 near the bottom of the device cuts through the liquid 17 on a relatively short horizontal line while diagonal shot line 22 cuts through the liquid on a substantially longer diagonal line. For the illustrative dimensions in the Figure, the length of shot line 20 through the liquid is 3.0" while the length of shot line 22 through the liquid is 3.6", a difference of 20%. It should be understood that the actual dimensions of an embodiment are provided in FIG. 2 so as to clearly illustrate the principle of the invention. However, the invention is in no way limited to such dimensions, and other actual dimensions may be used.

Referring now to the right side of the Figure, which employs a frusto-conical inner liquid boundary and a cylindrical outer liquid boundary, it is seen that shot line 24 which traverses the liquid horizontally near the bottom has a length through the liquid of a little less than 3.3", while diagonal shot line 26 traverses the liquid near the top and has a length through the liquid of 3.2". In other words, due to the fact that the thickness of the liquid varies in a predetermined manner, all individual shot lines through the liquid have about the same length.

The significance of this is as follows. The containment apparatus is man-portable and is designed to be carried by two men when liquid-filled. Thus, there is a weight limitation imposed on the device, and the volume of the shell can only be so large and not any larger to keep the weight of the liquid down. In the prior art device depicted in the left portion of FIG. 2, the relatively short shot line of 3.0" through the liquid at the bottom is an area of potential weakness, and exploded fragments will be more likely to be able to penetrate the outer wall over this region because there is less of a liquid cushion. On the other hand, in the right portion of FIG. 2, the shot line is about the same no matter what the path, so there is no region of potential weakness through which fragments may penetrate. It should be understood that in accordance with the invention the particular slope of the inner wall relative to the outer wall is arranged to produce the uniform shot line. The arrangement of the invention may thus be expected to result in fewer fragment penetrations than in the prior art shown in FIG. 1.

Figure 3:
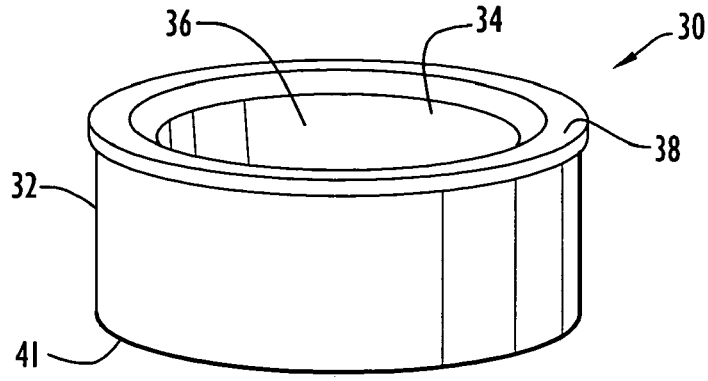
FIG. 3 shows an embodiment of the present invention.
Figure 4:
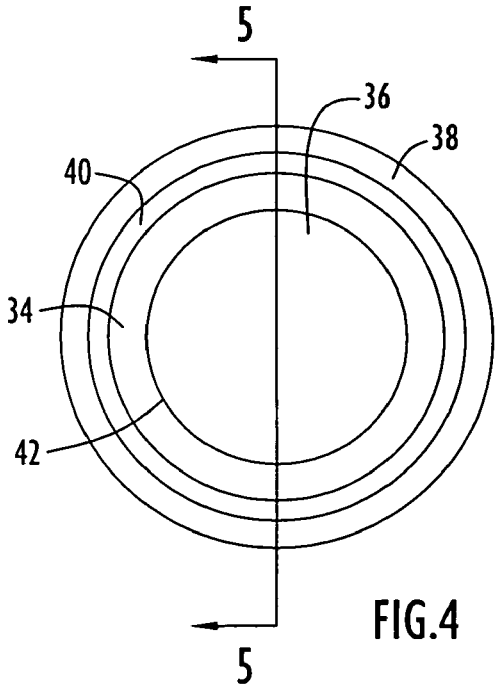
FIG. 4 is a top view of the embodiment of FIG. 3.
Figure 5:
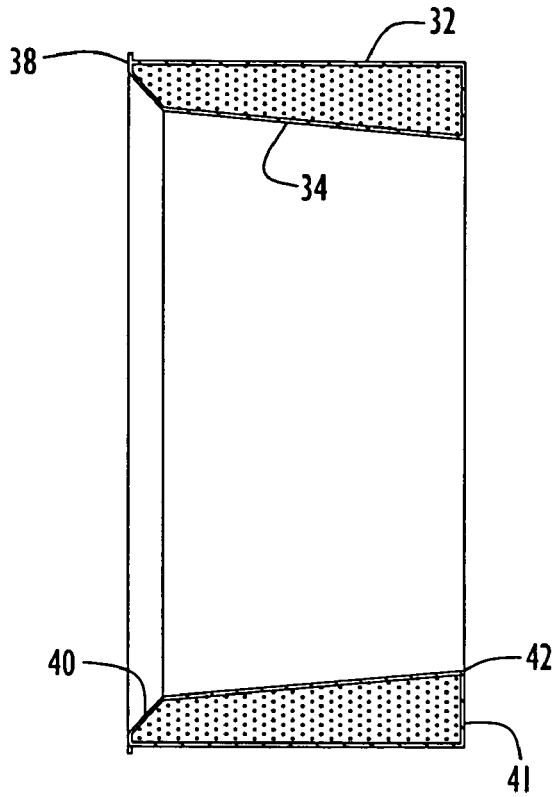
FIG. 5 is a sectional view taken through a diameter of FIG. 4.

An embodiment of the present invention is shown in FIGS. 3 to 6. Referring to FIG. 3, container 30 is depicted having outer cylindrical wall 32 and inner wall 34 of frusto-conical shape. Additionally, a top portion comprised of flat portion 38 and beveled portion 40 is disposed between the inner and outer walls at the top of the container while bottom portion 41 is between the two walls at the bottom, creating a closed shell container. FIG. 4 is a top view of the container of FIG. 3 and shows cavity 36 as being interior to bottom edge 42 of inner wall 34. FIG. 5 is a section through plane A-A of FIG. 4, and more clearly shows the slope of inner wall 34 of frusto-conical shape relative to cylindrical wall 32.

Figure 6:
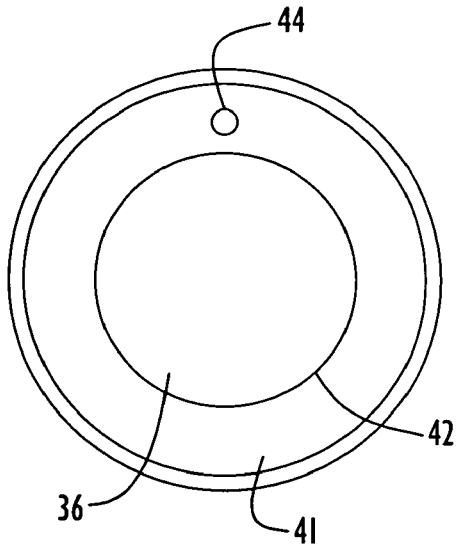
FIG. 6 is a bottom view of the embodiment of FIG. 3.

FIG. 6 is a bottom view of the container and shows bottom portion 41 having fill/drain port 44 for filling the shell with liquid and for emptying it. The port may be located elsewhere on the container, such as in the top portion, and if desired there can be separate fill and exhaust ports. The container may be made of soft plastic such as polyethylene and may be wrapped with ballistic material which will aid in suppressing exploded fragments. For example, a ballistic laminate wrap of Kevlar, non-woven Kevlar and latex rubber on the outside surface may be used.

In general, keeping in mind the weight limitation of the filled container discussed above, the container is wider than it is tall, so that shot lines which can potentially cause the most damage, i.e., those which project at shallower angles from an explosion are intercepted by the container and liquid, while steeper shot lines may exit the cavity through the top. As discussed in further detail below, the top of the cavity may be covered with a lid, which in general aids in suppression of the pressure blast and fragments.

In accordance with the invention, the slope of the conically shaped inner wall or the portion of the inner wall which is conically shaped, is arranged to be of a magnitude which renders the shot line through the liquid to be about uniform. While, as depicted in FIG. 2, there are many individual shot lines through the liquid, the term "the shot line through the liquid" as used herein means the group of shot lines comprising all individual shot lines through the liquid originated by a hypothetical explosion at or near the bottom of the center of the cavity which pass through both the inner wall or the portion of the inner wall which is conically shaped and the outer wall but do not touch any other portion of the container or lid. Also, the term "explosive device" as used herein includes any article or carrier for the actual device, and the term "about uniform" as used herein means uniform within approximately 10%.

It should be understood that the slope which will provide a uniform shot line through the liquid is to a certain extent related to the outside diameter and height of the container. Once these dimensions as well as the minimum allowable liquid thickness are determined, which can be by trial and error, the slope which will provide a uniform shot line through the liquid can be determined with simple geometry. For dimensions considered to be most practical by the inventor, the slope of the inner container wall relative to the outer wall is preferably in the range of from 5° to 15° and most preferably in the range of from 6° to 10°. In an actual embodiment which was built, the slope was about 6°.

Figure 7:
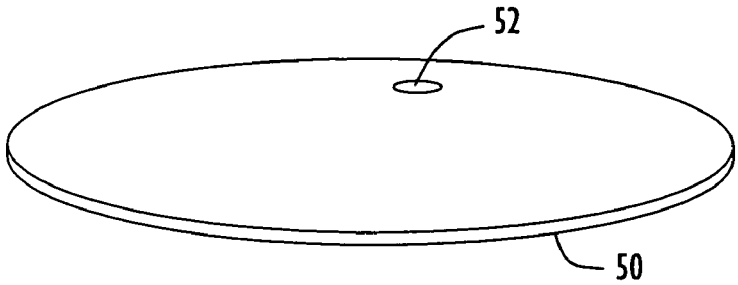
FIG. 7 shows a lid which may be used with the embodiment of FIG. 3.
Figure 8:
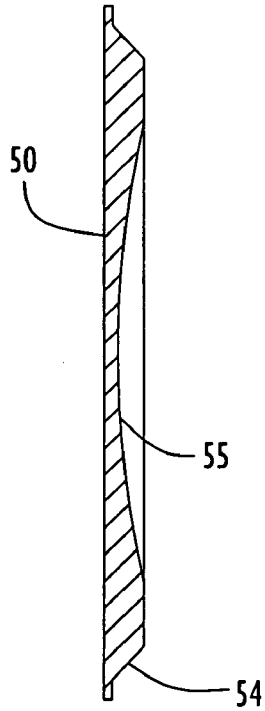
FIG. 8 is a sectional view of the lid of FIG. 7.

FIG. 7 is a perspective view of a lid 50 which may be used with the container, and FIG. 8 is a sectional view of such lid. It should be understood that the container may be used with or without a lid, and that various types of lids may be used. Also, the lid may be filled with a liquid if desired, and lid 50 shown in FIG. 7 has a port 52 through which liquid can be filled and emptied. Referring to the sectional view of FIG. 8, circular abutment 54 is shown, which interfaces with beveled surface 40 shown in FIGS. 3 and 5, so that the lid "fits" into the top of the container. If desired, the part of the lid which projects inside the cavity can have various shapes including but not limited to hemispherical.

As mentioned, the container and possibly the top would be filled with a liquid, which may be water or a mixture of water and an anti-freezing agent, or which may be some other liquid. The container can be supplied to customers either filled with liquid or unfilled. The container, or more typically a fabric covering for the container, would have handles to permit it to be carried, usually by two persons.

The container may be placed over the suspected explosive device with the lid off so that personnel would have a clear view of the device inside the cavity. The device would preferably be located in about the center of the cavity. After situating the container in such position, the lid would be placed over the top, and the apparatus would be ready to do its job in suppressing or containing any explosion which might occur.

Figure 9:
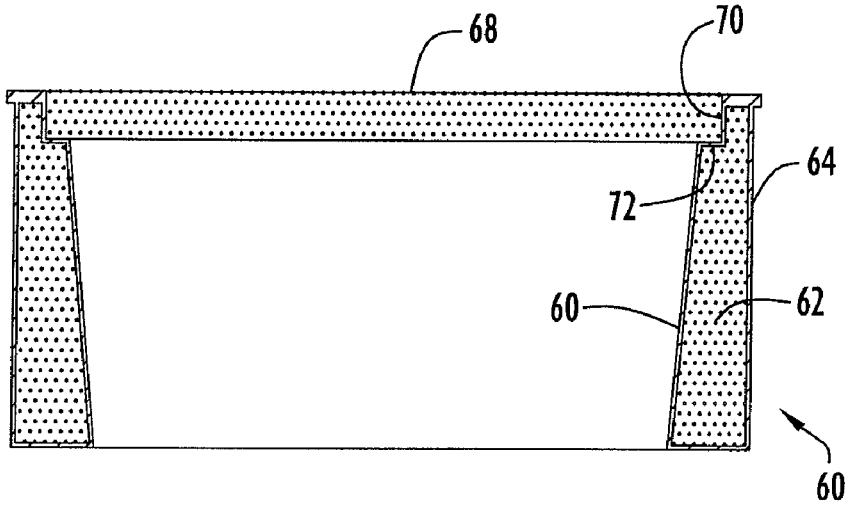
FIGS. 9 to 11 depict a further embodiment of the invention.
Figure 10:
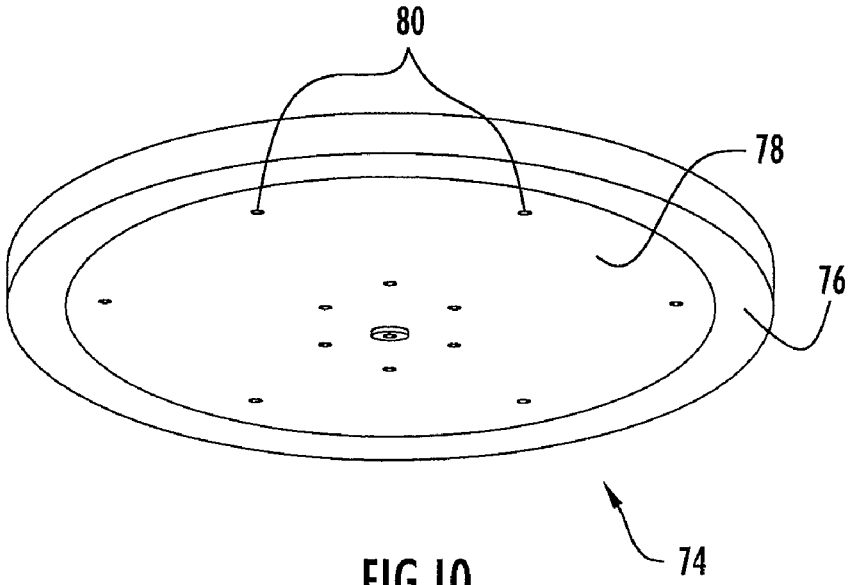
Figure 11:
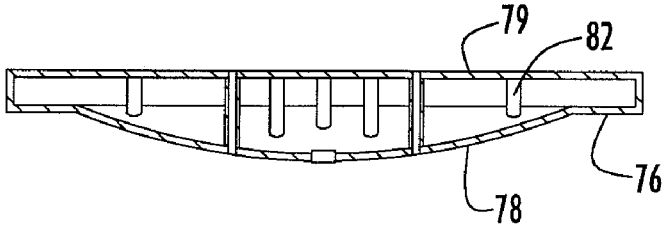

FIGS. 9 to 11 show a further embodiment of the invention, wherein the lid is inset in the container to provide more resistance to an explosion. Referring to the sectional view of FIG. 9, apparatus 60 is depicted, comprised of container 62 and lid 68. The container has an inset near the top comprised of cylindrical surface 70 and annular surface 72 which is substantially perpendicular to surface 70. The lid 68 is liquid filled, and sits in the recess.

FIG. 10 is a perspective view of the lid, while FIG. 11 is a sectional view taken through a center line of the lid. It is seen that the lid is comprised of interior wall 78 and exterior wall 79. The interior wall 78 is substantially hemispherically shaped, but has an outside portion 76 which is flat. There are holes 80 in the interior and exterior walls which are filled with hollow reinforcing tubes 82, which extend between the two walls. The sectional view of FIG. 10 is taken on a plane which cuts through only two of the tubes. The tubes, provide structural rigidity, and would help prevent breakage if a user were to attempt to sit or stand on the device.

While the invention has been illustrated in connection with illustrative and preferred embodiments, it should be understood that variations will occur to those skilled in the art without departing from the spirit and scope of the invention. For example, it is emphasized that the dimensions given in FIG. 2 are illustrative only and non-limiting. Also, the terms "cylindrical" and "frusto-conical" are used herein in their broad sense, meaning that while circular cylinders and cones are preferred, polygonal cylinders and cones are possible and fall within the scope of the invention.

Thus, it is to be understood that the invention to be covered herein is defined by the following claims and their legal equivalents.

What is claimed is:

1. A suppression apparatus for a suspected explosive device comprising a container which surrounds a cavity, wherein the container comprises a shell having an outer wall and an inner wall having a space therebetween, the outer wall having a surface of cylindrical shape which faces the interior of the shell and the inner wall having a surface which faces the interior of the shell, at least a portion of said surface of the inner wall which extends for either the entire height of the inner wall or substantially said entire height being of frusto-conical shape, wherein no part of the container covers either the bottom or the top of the cavity and wherein the slope of the surface portion of frusto-conical shape relative to the surface of cylindrical shape is such that when the container is filled with liquid the variation in thickness of the liquid renders the shot line through the liquid for an explosion from an explosive device to be about uniform when the explosive device is located in the cavity on a surface on which the container sits.

2. The apparatus of claim 1 wherein the container comprises top and bottom portions respectively disposed between the outer and inner walls.

3. The apparatus of claim 1 wherein the space between the outer and inner walls is greater near the bottom portion of the container than near the top portion.

4. The apparatus of claim 3 wherein the magnitude of said slope is in a range of 5° to 15°.

5. The apparatus of claim 3 wherein the container has a fill port.

6. The apparatus of claim 4 wherein the magnitude of said slope is in a range of 6° to 10°.

7. The apparatus of claim 4 wherein the container is filled with liquid.

8. The apparatus of claim 6 wherein the magnitude of said slope is about 6°.

9. The apparatus of claim 3 further comprising a separate lid for the container for covering the top of the cavity.

10. The apparatus of claim 9 wherein the lid is capable of being filled with liquid.

11. The apparatus of claim 10 wherein the lid is filled with liquid.

12. The apparatus of claim 11 wherein the container has an inset near its top comprised of a cylindrical surface and an annular surface perpendicular to the cylindrical surface, wherein the lid is shaped to sit in said inset.

13. The apparatus of claim 12 wherein the lid has a hemispherically shaped surface having a pole which extends towards the interior of the cavity when the lid sits in the inset.

14. The apparatus of claim 13, wherein the lid is structurally reinforced with tubing.

15. The apparatus of claim 1 wherein the container is filled with liquid.

16. The apparatus of claim 1 wherein said slope is in a range of from 5° to 15°.

17. The apparatus of claim 16 wherein said slope is about 6°.

* * * * *